US007915977B2

(12) United States Patent
Rhodes et al.

(10) Patent No.: US 7,915,977 B2
(45) Date of Patent: Mar. 29, 2011

(54) TUNEABLE BANDPASS FILTER

(75) Inventors: John David Rhodes, Menston (GB); Christopher Ian Mobbs, Menston (GB); David Ibbetson, Oxenhope (GB)

(73) Assignee: Isotek Electronics Limited, Leeds (GB)

( * ) Notice: Subject to any disclaimer, the term of this patent is extended or adjusted under 35 U.S.C. 154(b) by 365 days.

(21) Appl. No.: 11/858,024

(22) Filed: Sep. 19, 2007

(65) Prior Publication Data

US 2009/0072927 A1 Mar. 19, 2009

(51) Int. Cl.
*H01P 1/20* (2006.01)
*H01P 7/06* (2006.01)

(52) U.S. Cl. ..... 333/202; 333/230; 333/235; 333/231

(58) Field of Classification Search ..... 333/165–168, 333/173, 175, 185, 186, 202, 204, 205, 208, 333/209, 227, 230, 235, 219

See application file for complete search history.

(56) References Cited

U.S. PATENT DOCUMENTS

| | | | | |
|---|---|---|---|---|
| 4,216,448 | A | 8/1980 | Kasuga et al. | |
| 6,046,658 | A * | 4/2000 | Tatomir et al. | 333/208 |
| 6,300,849 | B1 * | 10/2001 | Takeda | 333/202 |
| 6,337,610 | B1 | 1/2002 | Williams et al. | |
| 2004/0056737 | A1 | 3/2004 | Carpintero et al. | |
| 2009/0134953 | A1 * | 5/2009 | Hunt et al. | 333/168 |

FOREIGN PATENT DOCUMENTS

| | | | |
|---|---|---|---|
| DE | 10304524 | A1 | 8/2004 |
| EP | 172880 | A1 | 1/2002 |
| EP | 1411582 | A1 | 4/2004 |
| GB | 2284311 | A | 5/1995 |
| GB | 2361057 | A | 10/2001 |
| WO | WO02/099969 | A2 | 12/2002 |

OTHER PUBLICATIONS

Chen et al., Wideband Coplanar-Waveguide Bandpass Filters With Good Stopband Rejection, IEEE Microwave and Wireless Components Letters, vol. 14, No. 9, Sep. 2004, pp. 422-424.

Gomez-Garcia et al., Exact Synthesis of Bandpass Responses Using an Isolated Cascade Connection of Same Order Lowpass and Highpass Filters, ISCAS 2004, pp. 153-156.

Yang et al., Planar Microstrip UWB Bandpass Filter Using U-Shaped Slot Coupling Structure, Electronic Letters, vol. 42, No. 25, Dec. 7, 2006, 2 pages.

Yildirim, A Revision of Cascade Synthesis Theory Covering Cross-Coupled Filters, IEEE Transactions on Microwave Theory and Techniques, vol. 50, No. 6, Jun. 2002, pp. 1536-1543.

International Search Report, PCT/GB2008/003082, Feb. 16, 2009, 6 pages.

Search Report Under Section 17, UK Intellectual Property Office, GB0718275.1, Jan. 9, 2009, 1 page.

* cited by examiner

*Primary Examiner* — Robert Pascal
*Assistant Examiner* — Gerald Stevens
(74) *Attorney, Agent, or Firm* — Howard & Howard Attorneys PLLC

(57) ABSTRACT

A tuneable bandpass filter includes a plurality of coupled resonators. A common structure of the filter includes at least one common coupling or one common resonator. An upper loop includes first and second end resonators coupled together by a signal path and further includes at least one further signal path extending between end resonators. The further signal path includes at least one further resonator with the end resonators being coupled to the common structure. A lower loop includes first and second end resonators coupled together by a signal path and further includes at least one further signal path extending between end resonators. The further signal path includes at least one further resonator with the end resonators being coupled to the common structure.

18 Claims, 9 Drawing Sheets

TUNEABLE BANDPASS FILTER

The present invention relates to a tuneable bandpass filter. More particularly, but not exclusively, the present invention relates to a tuneable bandpass filter comprising a plurality of coupled resonators, the resonators being arranged in first and second loops, each connected to a common structure, the resonators being arranged such that the filter can be de-composed into low pass and high pass sub filters, one sub filter being arranged to receive the output of the other.

There are many requirements which require a filter constructed from coupled resonant structures to be tuned with control over operating bandwidth and frequency whilst retaining fixed absolute rejection requirements relative to the band edges. Using known synthesis and implementation methods tuning band pass filters with variable frequency and bandwidth would require tuning of both the resonant frequency of the resonators and the coupling between the resonators and would only meet relative rejection requirements. This results in filters which are complex to implement.

The tuneable bandpass filter according to the invention seeks to overcome this problem.

Accordingly, the present invention provides a tuneable bandpass filter comprising a plurality of coupled resonators, the filter comprising

- a common structure comprising at least one common coupling or one common resonator;
- an upper loop comprising first and second end resonators coupled together by a signal path, the loop further comprising at least one further signal path extending between end resonators, the further signal path comprising at least one further resonator, the end resonators being coupled to the common structure;
- a lower loop comprising first and second end resonators coupled together by a signal path, the loop further comprising at least one further signal path extending between end resonators, the further signal path comprising at least one further resonator, the end resonators being coupled to the common structure;
- the resonators being coupled together such that the bandpass filter can be divided into a low pass sub filter and a high pass sub filter, one of the sub filters being arranged to receive the output of the other.

The tuneable bandpass filter according to the invention has a bandwidth and centre frequency of bandpass response which can be tuned by tuning the resonators only, without the need to adjust the coupling between resonators.

The common structure can comprise a single common resonator, the end resonators of the upper and lower loops being connected to the common resonator.

The low pass sub filter can comprise the common resonator and the resonators of the lower loop.

The high pass sub filter can comprise the common resonator and the resonators of the upper loop.

Alternatively, the common structure can comprise a plurality of common couplings coupled between the upper and lower loops.

The common couplings can be arranged such that each end resonator of a loop is coupled to both end resonators of the other loop.

The upper loop can comprise an even number of resonators.

Alternatively, the upper loop can comprise an odd number of resonators.

The lower loop can comprise an even number of resonators.

Alternatively, the lower loop can comprise an odd number of resonators.

At least one of the upper loop and lower loop can comprise a plurality of resonators coupled together.

At least one of the loops can comprise a plurality of resonators coupled together in cascade such that there are a plurality of signal paths between end resonators.

At least some of the resonators of the at least one loop can be coupled together in a cross coupled ladder configuration.

At least some of the resonators in the cross coupled ladder configuration can further comprise at least one diagonal cross coupling to a resonator on an adjacent cross coupled ladder rung.

The filter can further comprise a non-resonant input circuit node coupled to an end resonator of one of the loops.

The filter can further comprise a group delay equalisation network further coupled between input circuit node and end resonator connected thereto.

The filter can further comprise an output circuit node coupled to an end resonator of the other loop.

The filter can further comprise a group delay equalisation network connected between output circuit node and end resonator connected thereto.

The present invention will now be described by way of example only, and not in any limitative sense with reference to the accompanying drawings in which FIGS. 1(*a*) and 1(*b*) show known coupled resonator bandpass filters having an even and odd number of coupled resonators respectively;

Bandpass filters at RF and microwave frequencies are commonly realised as networks of resonant circuits with coupling between them. Shown in FIGS. 1(*a*) and 1(*b*) are such known bandpass filters 1. The filters 1 each comprise a plurality of resonators 2. The resonators 2 are coupled together in cross coupled ladder configurations as shown. Input and output connections to the bandpass filters 1 are through non-resonant circuit nodes 3,4.

The synthesis of these networks to generate arbitrary asymmetric responses is known. The coupling elements shown as diagonal lines can be generated in either direction.

The center of the passband of the filter 1 is determined by the resonant frequency of the resonators 2 and the general shape of the response is determined by the ratios and topology of the couplings. Changing the center frequency of the filter 1 can be achieved by changing only the resonator frequency of the resonators 2. Changing the relative bandwidth of a filter 1 requires the modification of the coupling between the resonators 2 and the frequencies of the resonators 2. Such filters 1 tend to be complex both to manufacture and to use and in general will only retain a relative selectivity requirement if the couplings are not modified.

Figure 1B:
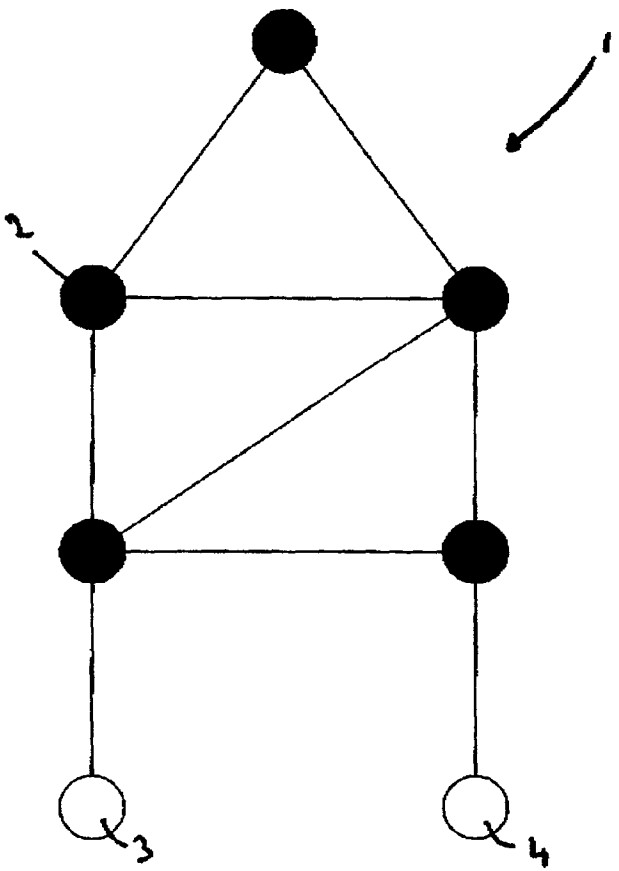
Figure 1(b) Prior Art
Figure 1A:
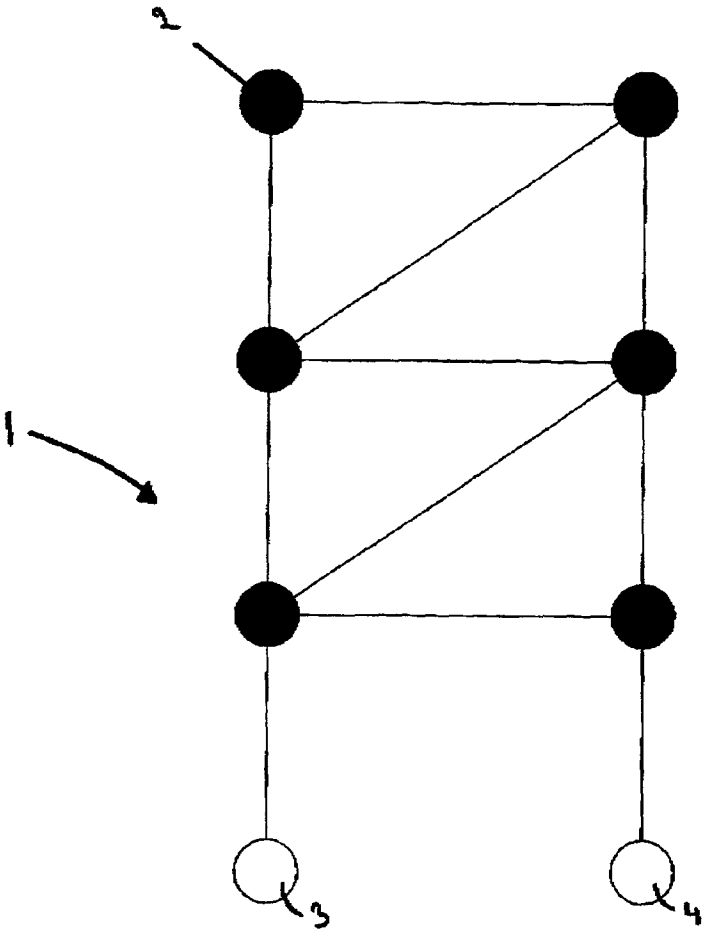
Figure 1(a) Prior Art

An infinite number of variants of the structures in FIG. 1 can be achieved by applying rotational transformations on the coupling matrix of the filter 1.

Figure 2:
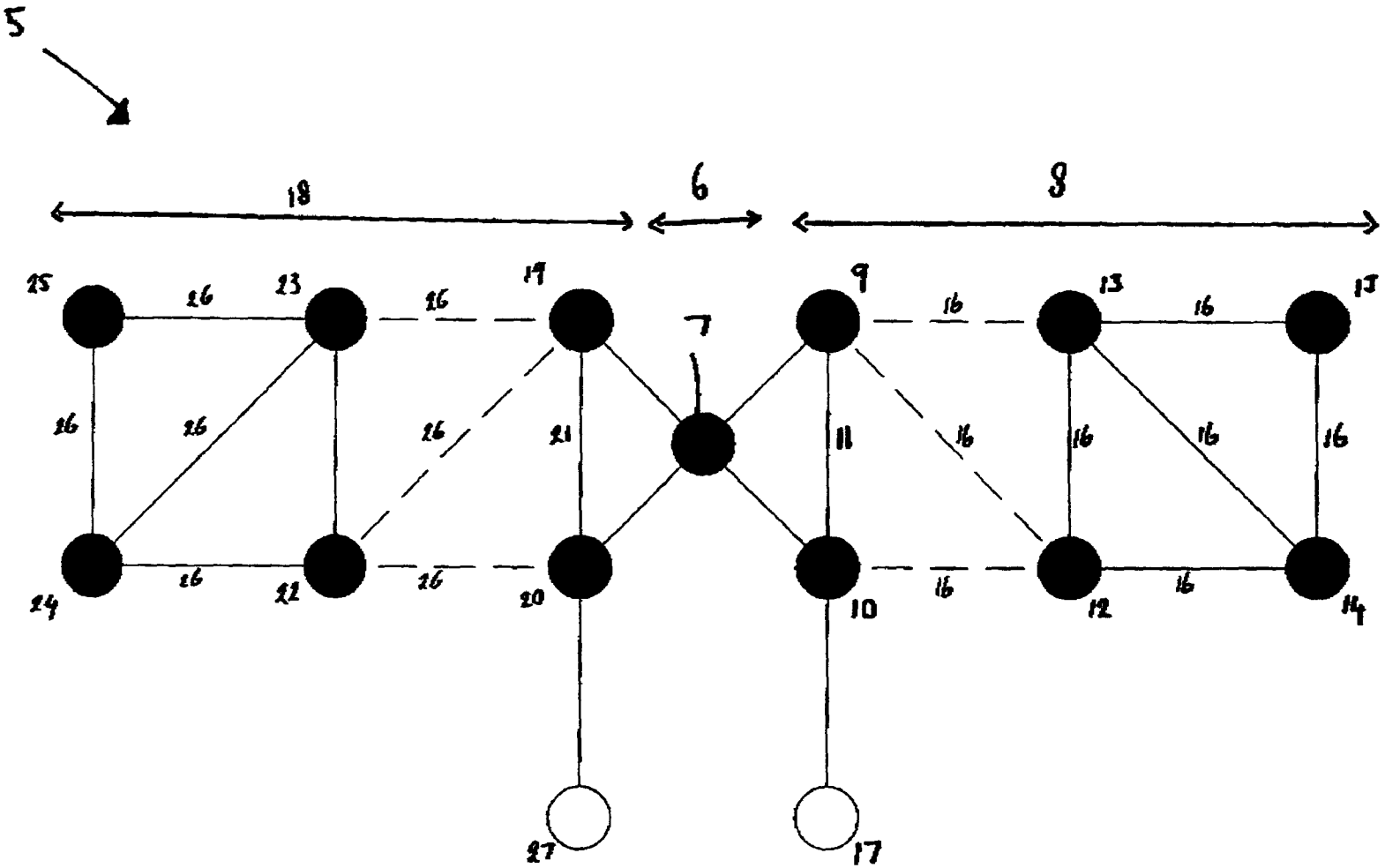
FIG. 2 shows a first embodiment of a tuneable bandpass filter according to the invention.

Shown in FIG. 2 is a tuneable bandpass filter 5 according to the invention. The filter 5 comprises a common structure 6 comprising a single common resonator 7. The filter 5 comprises an upper loop 8 comprising first and second end resonators 9,10 coupled together by a signal path 11. Each end resonator 9,10 is further coupled to the common resonator 7. The upper loop 8 further comprises a plurality of further resonators 12-15 coupled along a plurality of signal paths 16 between the end resonators 9,10. The resonators 9,10, 12-15 of the upper loop 8 are coupled in a cross coupled ladder configuration. The diagonal couplings 16 between the resonators on different rungs can be generated in either direction. The dotted lines show repeated units. In this embodiment the upper loop 8 comprises six resonators although other embodiments with 8, 10, 12 etc resonators are also possible. Coupled to one of the end resonators 10 of the upper loop 8 is a non-resonant output signal node 17.

The filter 5 also comprises a lower loop 18 comprising first and second end resonators 19,20 coupled together by a signal path 21. Each end resonator 19,20 is coupled to the common resonator 7. The lower loop 18 further comprises a plurality of further resonators 22-25 coupled along a plurality of signal paths 26 between end resonators 19,20. The topology of the lower loop 18 is such that, in this embodiment, the filter 5 has complex conjugate symmetry about the common resonator 7. Coupled to one of the end resonators 20 of the lower loop 18 is a non-resonant input signal node 27.

Figure 3:
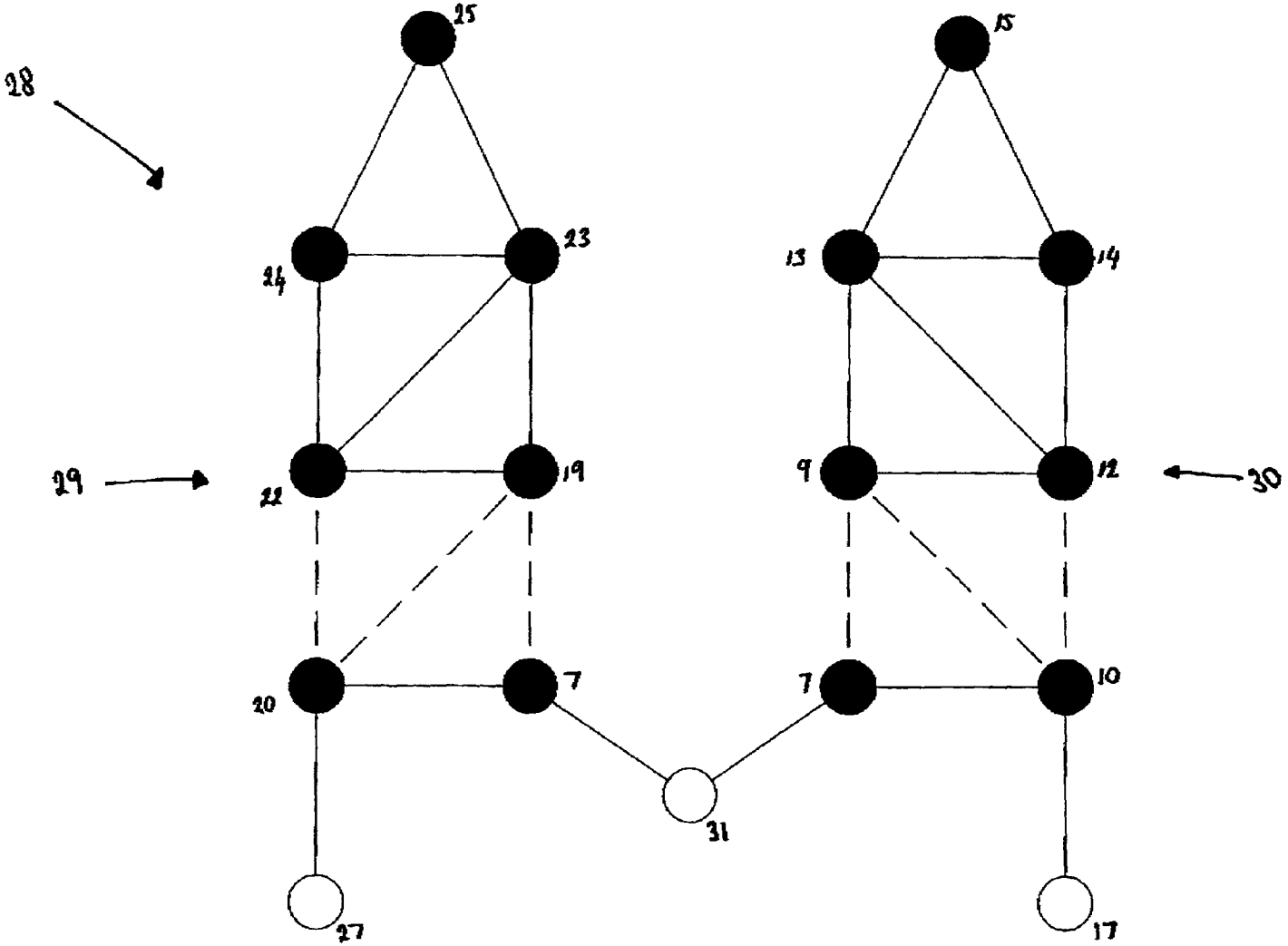
FIG. 3 shows an equivalent circuit for the filter of FIG. 2.

Shown in FIG. 3 is an equivalent circuit 28 for the tuneable bandpass filter 5 of FIG. 2. In the equivalent circuit 28 the tuneable bandpass filter 5 is split into two sub filters 29,30 connected together at a non-resonant node 31. Like resonators in the tuneable bandpass filter 5 and its equivalent circuit 28 are referenced by like reference numerals. One of the sub-filters 29 comprises a low pass sub filter 29 having a low pass band edge at frequency $w_1$. The other sub filter 30 comprises a high pass sub filter 30 having a high pass band edge at frequency $w_2$. The equivalent circuit 28 comprises one more resonant node than the tuneable bandpass filter 5. This is because the common resonator 7 is formed from a merging of the first resonator 7 of the low pass sub filter 29 with the first resonator 7 of the high pass sub filter 30.

Figure 4:
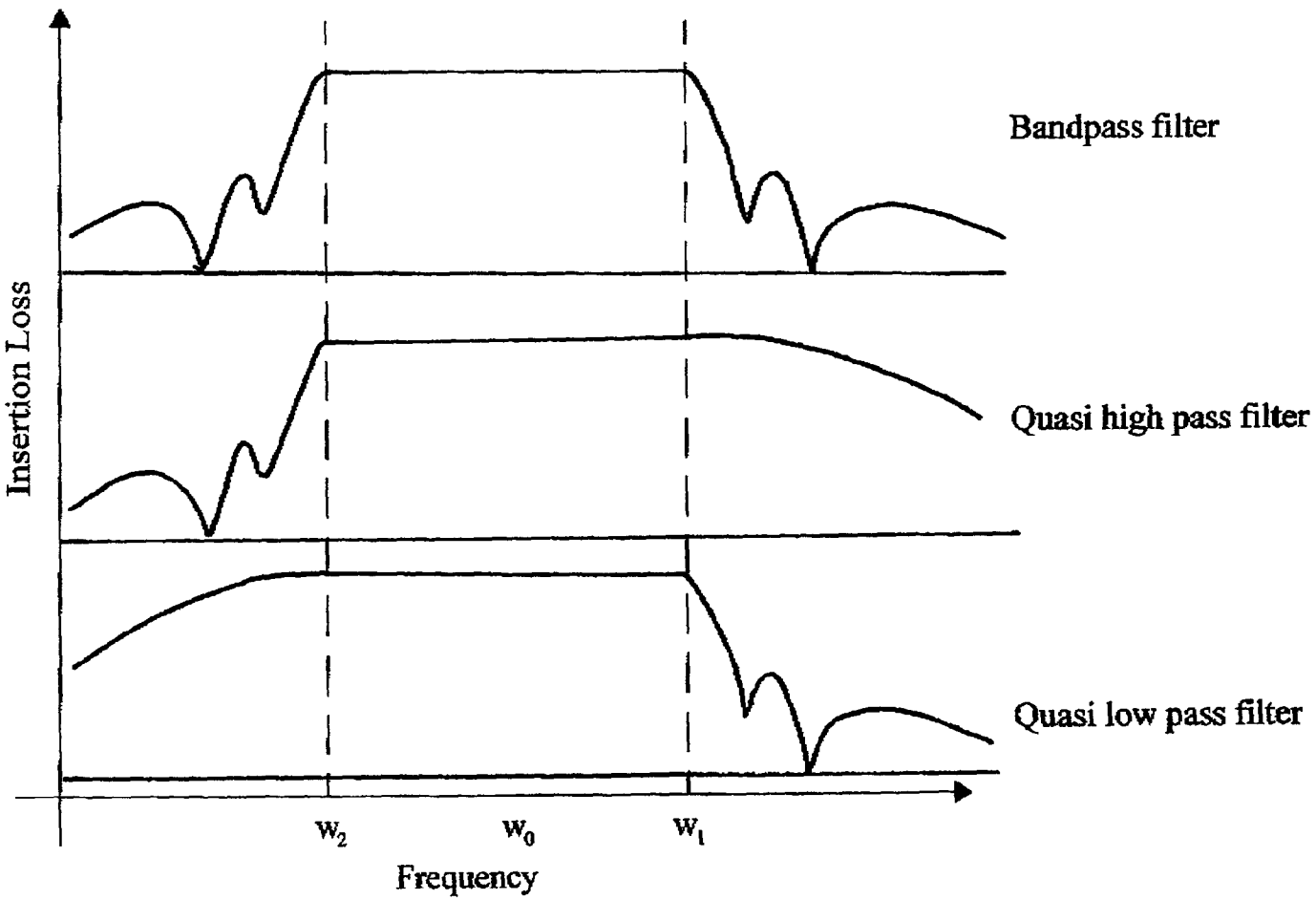
FIG. 4 shows a plot of insertion loss against frequency for the filter of FIG. 2.

The insertion loss of the tuneable band pass filter 5 is a combination of the insertion losses of the low pass and high pass sub filters 29,30 of the equivalent circuit 28. FIG. 4 shows the insertion loss of the tuneable bandpass filter 5 and also the insertion loss of the sub filters 29,30 of its equivalent circuit 28, taking into account the interaction of the two. As the band edge of the low pass sub filter 29 is at a higher frequency than the band edge of the high pass sub filter 30, the combined insertion loss comprises a bandpass region centred about $w_0$ having edges at $w_1$ and $w_2$ respectively.

The low pass and high pass sub filters 29,30 can be altered substantially independently of each other. Accordingly, in order to change the lower band edge one adjusts the resonant frequencies of the resonators 7,9,10,12,13,14,15 of the tuneable bandpass filter 5 which comprise the high pass sub filter 30 of its equivalent circuit 28. In order to change the upper band edge one adjusts the resonant frequencies of the resonators of the tuneable bandpass filter 5 comprising the low pass sub filter 29 of the equivalent circuit 28. By adjusting the upper and lower band edges one can adjust the centre and width of the bandpass region of the tuneable bandpass filter 5 purely by adjusting the resonant frequencies of the resonators and without the need to adjust the coupling between them. This significantly reduces the complexity of the tuneable bandpass filter 5 and increases its ease of use compared to known bandpass filters and preserves the same absolute selectivity.

The tuneable bandpass filter 5 of this embodiment normally has a high degree of symmetry. Because of the symmetry of the filter 5 the common resonator 7 is normally tuned to the centre of the filter passband. In order to change the bandwidth (constant centre frequency) one tunes all the resonators except the common resonator 7.

In an alternative embodiment of the invention (not shown) the tuneable bandpass filter 5 is asymmetric and can be decomposed into a low pass sub filter 29 of degree $n_L$ and high pass sub filter 30 of degree $n_H$. For such a filter 5 one must tune $n_L$ resonators to move the lower edge and $n_H$ resonators to move the upper edge (including the common resonator 7). To move the centre frequency of the response all resonators must be altered.

Figure 5:
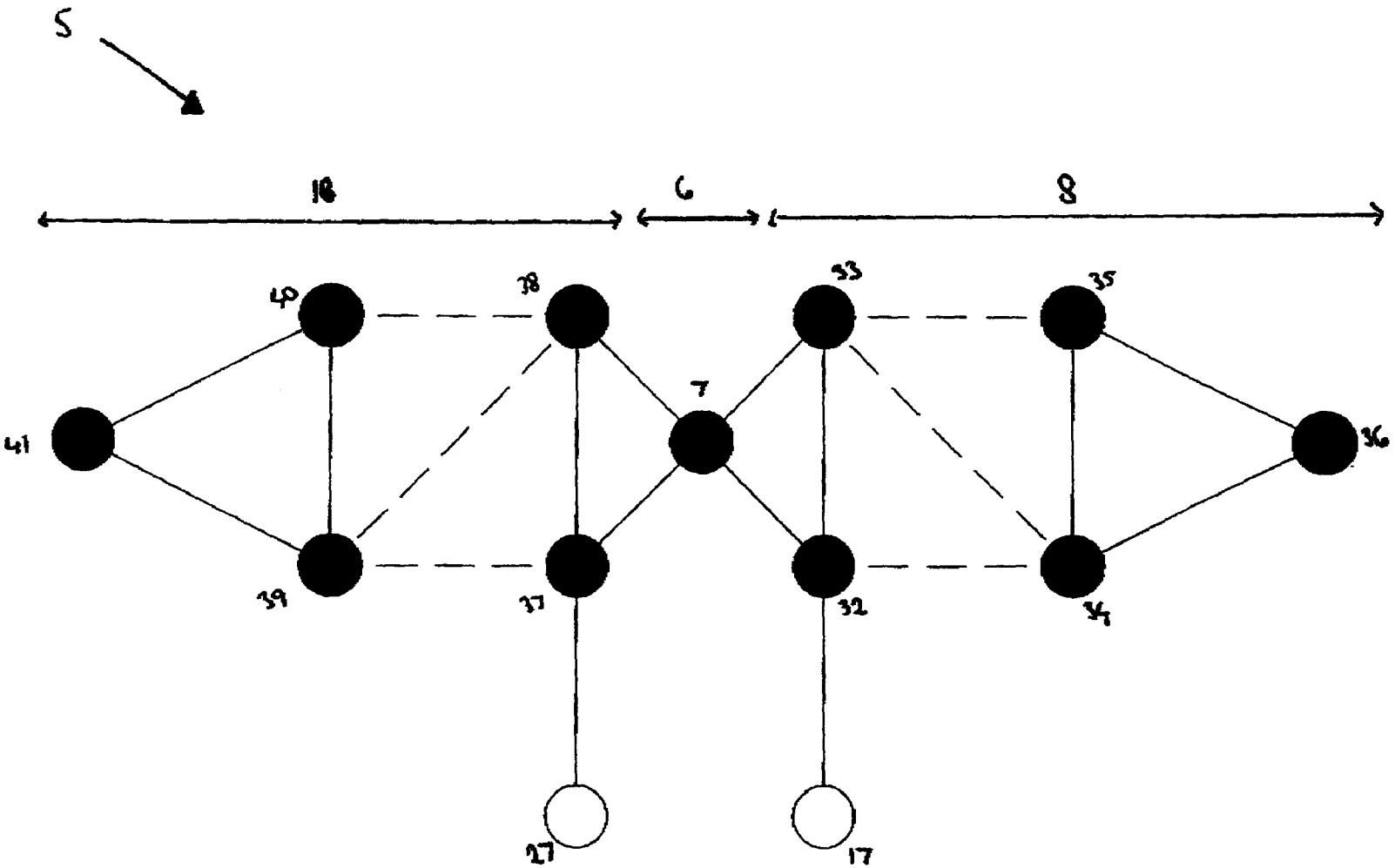
FIG. 5 shows a second embodiment of a tuneable bandpass filter according to the invention.
Figure 6:
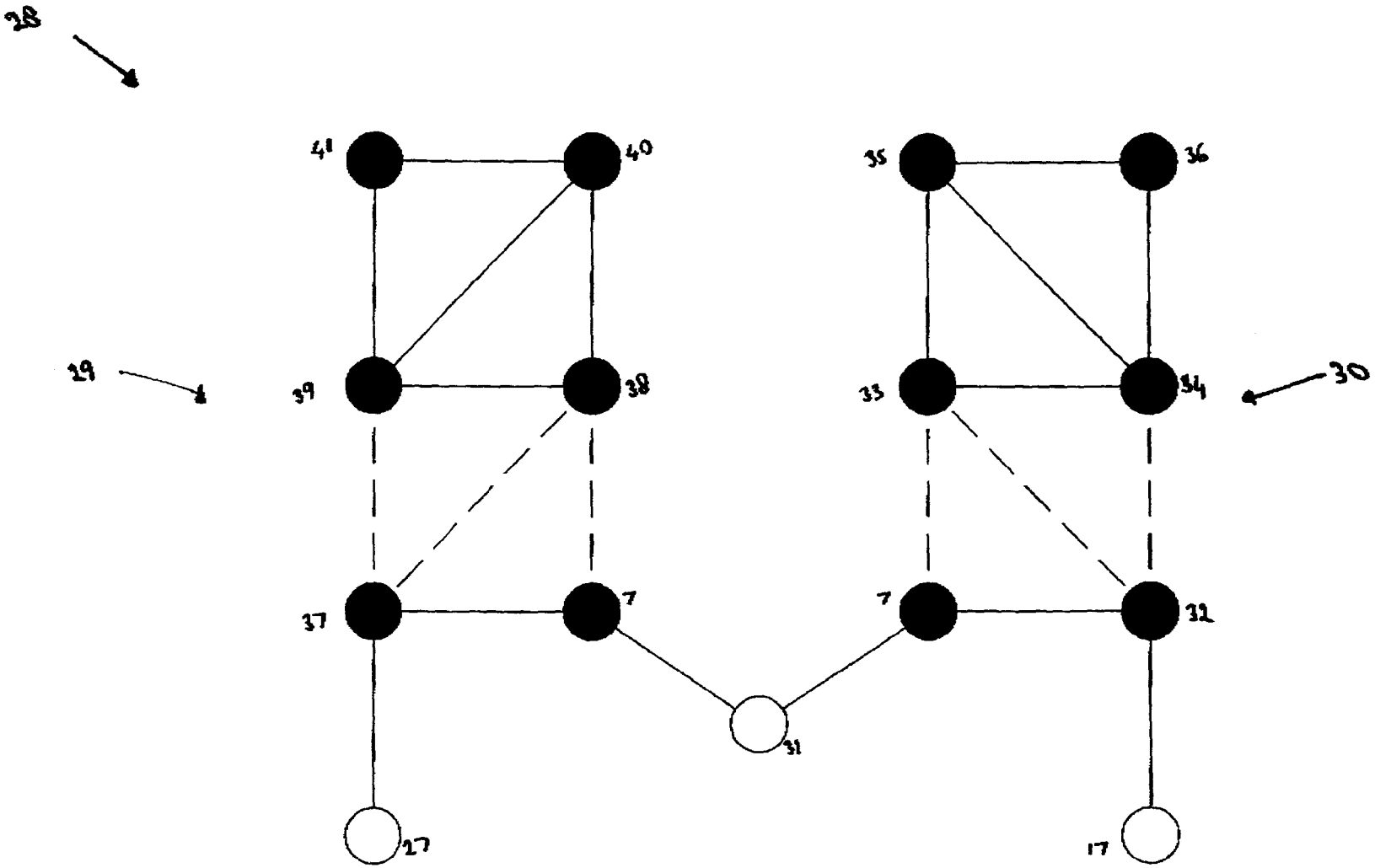
FIG. 6 shows an equivalent circuit for the filter of FIG. 5.

Shown in FIG. 5 is a further embodiment of a tuneable bandpass filter 5 according to the invention. In this embodiment the upper and lower loops 8,18 comprise an odd number of resonators. In the equivalent circuit 28 shown in FIG. 6 the two sub filters 29,30 have an even number of resonators. Again, the two sub filters 29,30 are low pass 29 and high pass 30 sub filters respectively.

Figure 7:
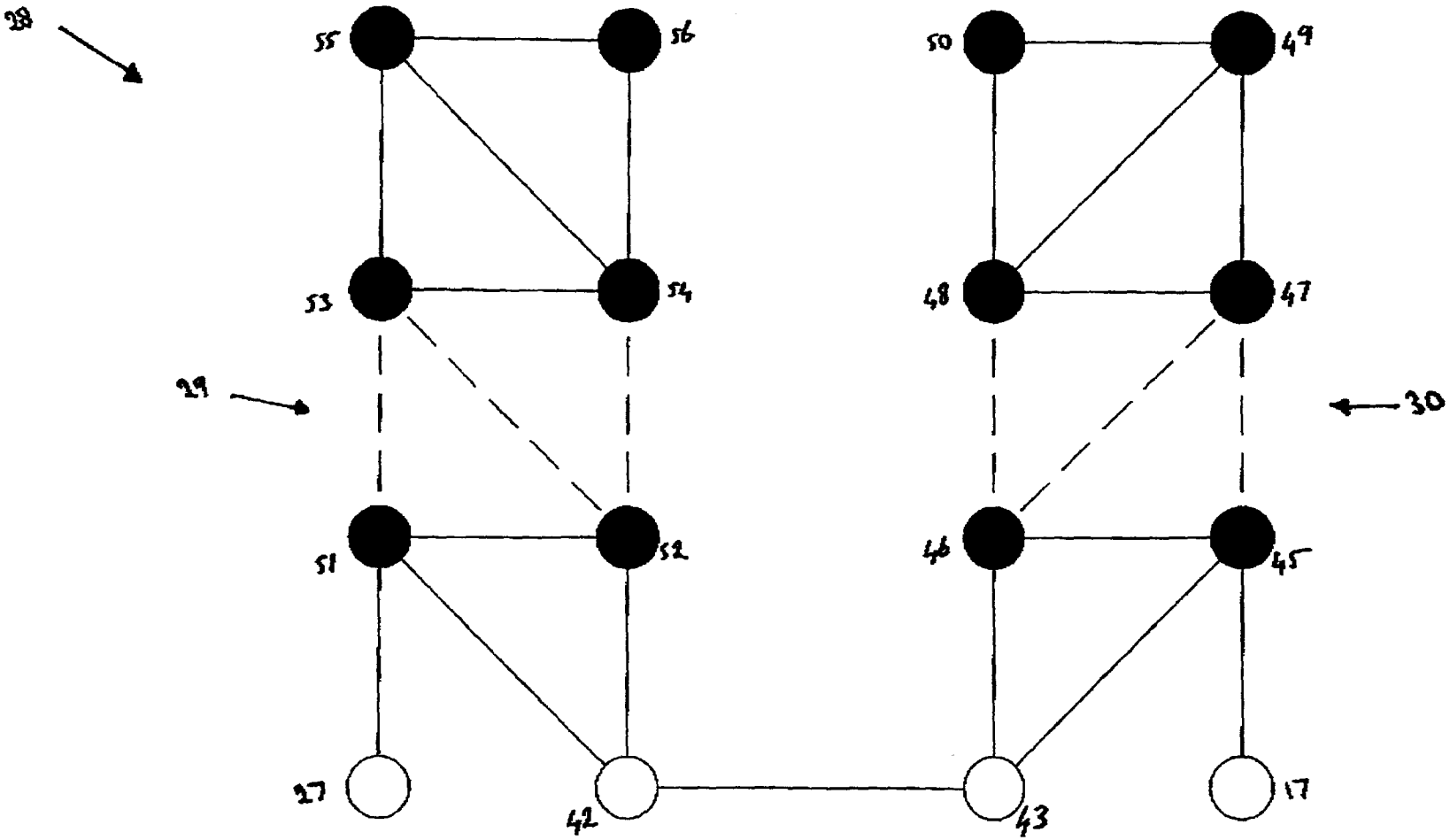
FIG. 7 shows an equivalent circuit for a further embodiment of a filter according to the invention.

In all of the above embodiments of the invention the low pass and high pass sub filters 29,30 of the equivalent circuits 28 have two transmission zeros at infinity. However, this is not necessary. Shown in FIG. 7 is the equivalent circuit 28 for a tuneable filter 5 wherein the low pass and high pass sub filters 29,30 have only one transmission zero at infinity. Moving one of the transmission zeros from infinity results in additional flexibility when meeting design specifications. The low and high pass sub filters 29,30 are now connected together by two non-resonant nodes 42,43.

Figure 8:
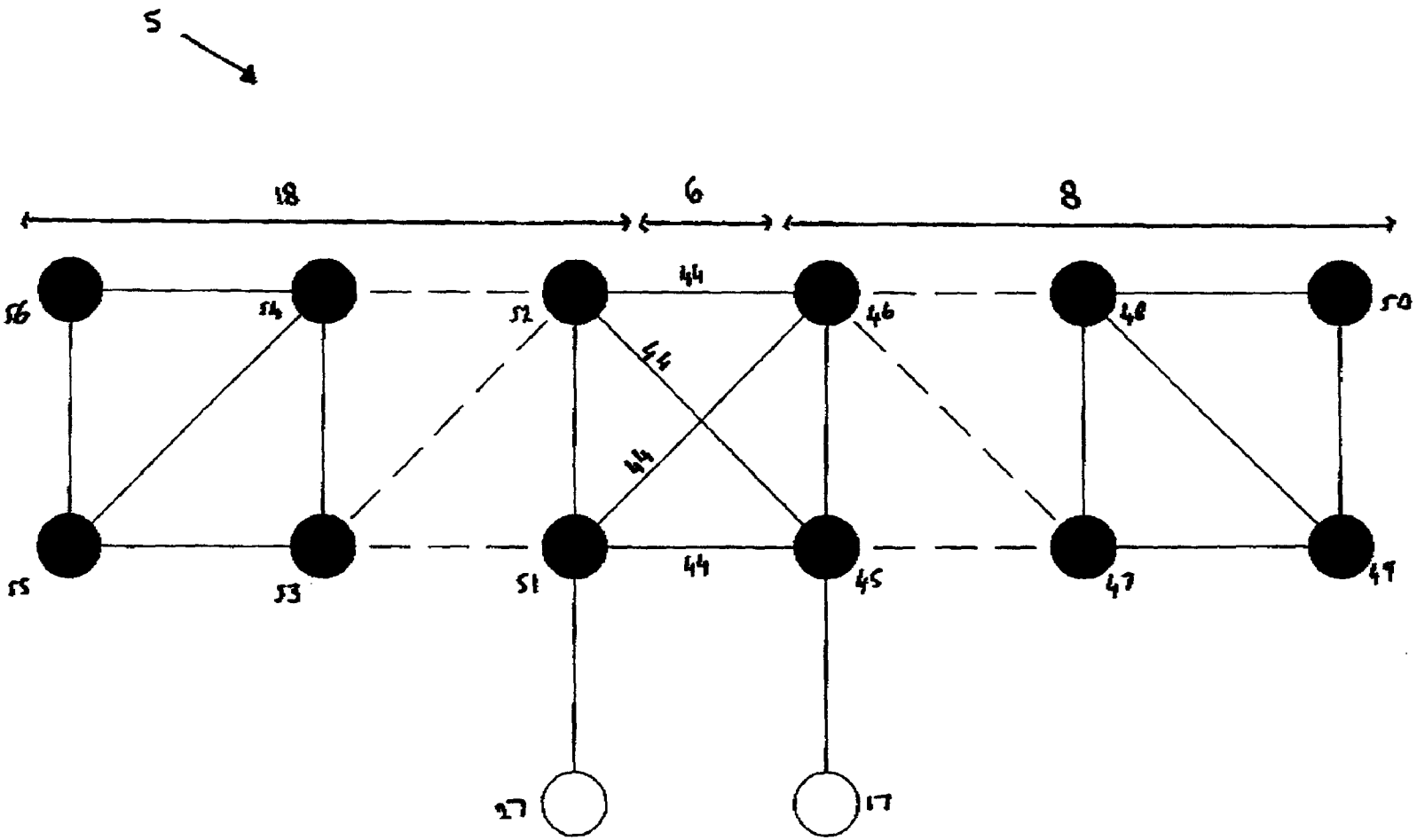
FIG. 8 shows a filter according to the invention having the equivalent circuit of FIG. 7; and, FIG. 9 shows a further embodiment of a filter according to the invention.

The topology of the tuneable bandpass filter 5 is shown in FIG. 8. As with the previous embodiments the filter 5 comprises upper and lower loops 8,18 each comprising a plurality of resonators. The common structure 6 however is more complex. In this embodiment the common structure 6 comprises a plurality of common couplings 44 arranged to fully couple the end resonators 45,46,51,52 of the upper and lower loops 8,18. Each end resonator 45,46,51,52 of one loop 8,18 is coupled to both end resonators 45,46,51,52 of the other loop 8,18.

The tuneable bandpass filter 5 of FIG. 8 retains the same basic properties of the other tuneable bandpass filters 5 according to the invention. In particular independent tuning of the bandpass filter bandwidth and centre frequency is achievable by tuning the relevant resonators. No tuning of the coupling between resonators is required to tune either centre frequency or bandwidth.

Figure 9:
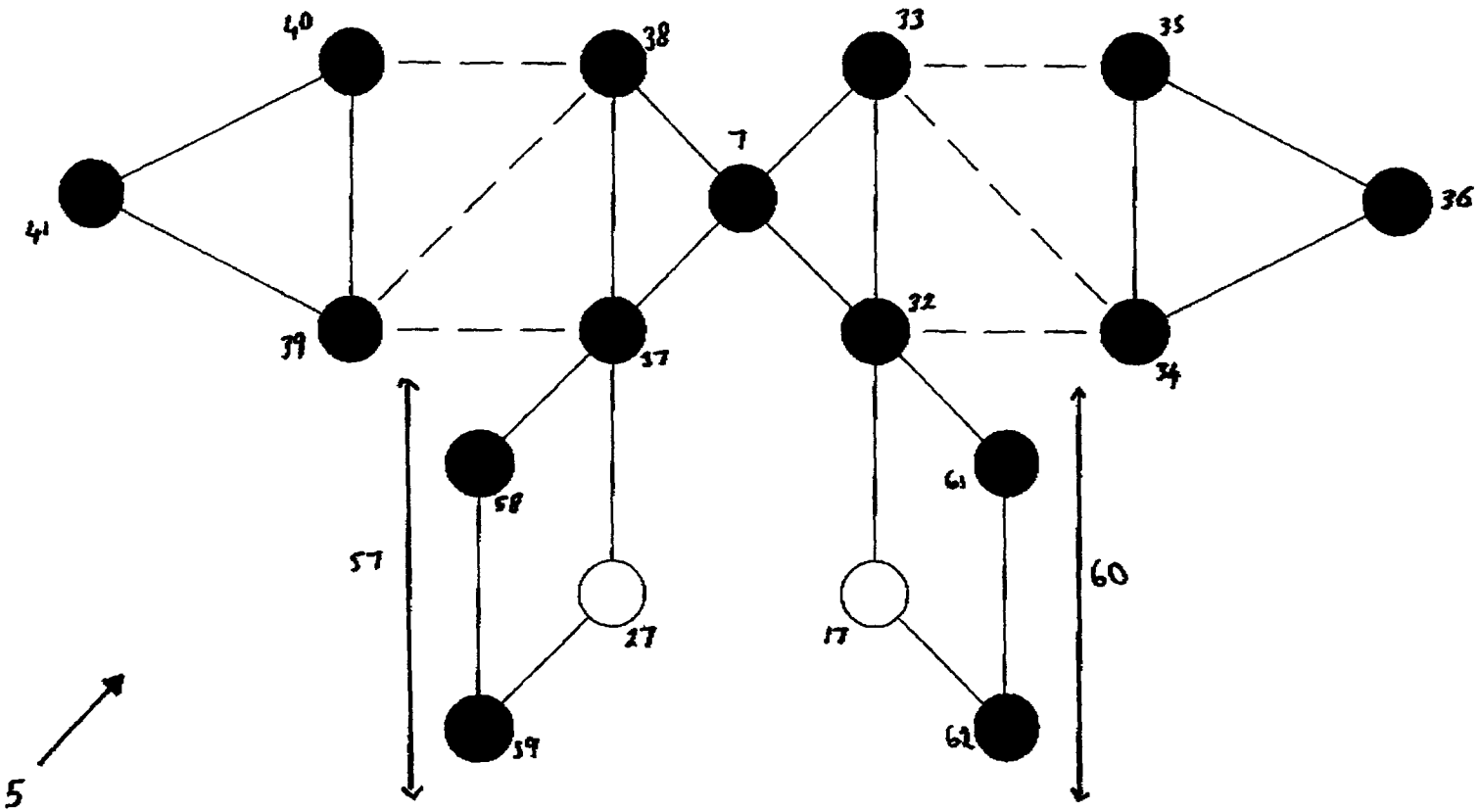

Shown in FIG. 9 is a further embodiment of a tuneable bandpass filter 5 according to the invention. An ideal filter would pass signals in a desired band whilst attenuating all unwanted signals with only a constant change in amplitude and constant time delay to the desired signals. If different frequency components of a complex signal arrive at different times the signal will be distorted. The requirement for a constant time delay equates to a need for a constant group delay. The absolute level of the delay is usually not important, what is important is the variation of the delay over the signal bandwidth.

The embodiment of the filter 5 of FIG. 9 further comprises a compensating group delay equalisation network 57 coupled between the input non-resonant node 27 and resonator 37 connected to the input node 27, in addition to the direct coupling between the two. The compensating group delay equalisation network 57 comprises a plurality of resonators 58,59 coupled together in series. A further compensating group delay equalisation network 60 is coupled between the output non-resonant node 17 and resonator 32 coupled to the output node 17. Again, this comprises a plurality of resonators 61,62 coupled together in series. Again, this is in parallel to the direct coupling between the output node 17 and resonator 32. The responses of the compensating group delay equalisation networks 57,60 are offset from the centre frequency of the desired bandpass response so that each compensating network 57,60 affects one half of the band more than the other. The group delay peak of the compensating networks 57,60 occurs at the nominal centre frequency of the compensator design. To compensate the group delay dip in the middle of the bandpass response, the nominal centre frequency of the compensators occurs within the passband of the bandpass response. In order to apply the correct compensation to the response they must be symmetrically spaced about the centre frequency of the bandpass response for symmetrical amplitude selectivity requirements.

The compensating group delay equalisation networks 57,60 can be tuned. The compensating group delay equalisation networks 57, 60 are adapted to track the tuning of the filter 5 by synchronising the frequencies, with the centre frequencies correctly offset, of the compensating group delay equalisation networks 57,60 relative to the overlap of the low pass and high pass sub filters 29,30 of the tuneable bandpass filter 5.

If the centre frequency of the compensating group delay equalisation networks 57,60 relative to the overlap of the low pass and high pass sub filters 29,30 is altered the amount of compensation and the relative position of the group delay ripples can be altered.

The compensating group delay equalisation networks 57,60 can be used to reduce the group delay variation for all tuneable bandwidths. In addition to reducing the group delay variation the variation in insertion loss in the compensation networks 57,60 also reduces the insertion loss variation across the passband, although this comes at the cost of increased minimum insertion loss.

The low pass sub filters 29 of the equivalent circuits 28 above are essentially bandpass filters with a performance tailored to favour stopband rejection above the passband of the tuneable bandpass filter 5 with little regard to performance below the passband of the tuneable bandpass filter 5. Such filters 29 are often termed 'quasi' low pass filters.

Similarly, the high pass sub filters 30 of the equivalent circuits 28 are essentially bandpass filters with a performance tailored to favour stopband rejection below the passband of the tuneable bandpass filter 5 with little regard to performance above the passband of the tuneable bandpass filter 5. Such filters 30 are often termed 'quasi' high pass filters.

The tuneable bandpass filter 5 according to the invention is typically used with resonators which resonate at microwave frequencies, producing a passband in the microwave region. Typically the resonators comprise cavity resonators (not shown) which are tuned by displacing a tuning member within the cavity. Two tuneable cavity resonators are typically coupled by means of an aperture which extends through the common wall of the two cavities.

In all of the above embodiments the resonators of the tuneable bandpass filter are connected together in arrangements such that the filter can be considered to be a quasi high pass sub filter and a quasi low pass sub filter connected together with one receiving the output of the other. In these embodiments the output of one sub-filter is connected to the input of the other by a number of non-resonant nodes, the number of nodes depending upon the order of the sub-filters.

The invention claimed is:

1. A tuneable bandpass filter comprising a plurality of coupled resonators, the tuneable bandpass filter comprising:

a common structure comprising at least one common coupling or one common resonator;

an upper loop comprising first and second end resonators coupled together by a signal path, the upper loop further comprising at least one further signal path extending between the first and second end resonators of the upper loop, the at least one further signal path of the upper loop comprising at least one further resonator, the first and second end resonators of the upper loop being directly coupled to the common structure;

a lower loop comprising first and second end resonators coupled together by a signal path, the lower loop further comprising at least one further signal path extending between the first and second end resonators of the lower loop, the at least one further signal path of the lower loop comprising at least one further resonator, the first and second end resonators of the lower loop being directly coupled to the common structure;

the resonators being coupled together such that the tuneable bandpass filter is divided into a low pass sub filter and a high pass sub filter, one of the low pass and high pass sub filters being arranged to receive an output of the other.

2. The tuneable bandpass filter as claimed in claim 1, wherein the common structure comprises a single common resonator, the first and second end resonators of the upper and lower loops being connected to the common resonator.

3. The tuneable bandpass filter as claimed in claim 2, wherein the low pass sub filter comprises the common resonator and the resonators of the lower loop.

4. The tuneable bandpass filter as claimed in claim 2, wherein the high pass sub filter comprises the common resonator and the resonators of the upper loop.

5. The tuneable bandpass filter as claimed in claim 1, wherein the at least one common coupling comprises a plurality of common couplings coupled between the upper and lower loops.

6. The tuneable bandpass filter as claimed in claim 5, wherein the plurality of common couplings are arranged such that each of the first and second end resonators of one of the upper and lower loops is coupled to both of the first and second end resonators of the other loop.

7. The tuneable bandpass filter as claimed in claim 1, wherein the upper loop comprises an even number of resonators.

8. The tuneable bandpass filter as claimed in claim 1, wherein the upper loop comprises an odd number of resonators.

9. The tuneable bandpass filter as claimed in claim 1, wherein the lower loop comprises an even number of resonators.

10. The tuneable bandpass filter as claimed in claim 1, wherein the lower loop comprises an odd number of resonators.

11. The tuneable bandpass filter a claimed in claim 1, wherein the at least one further resonator of the upper and/or the lower loop is further defined as a plurality of further resonators coupled together.

12. The tuneable bandpass filter as claimed in claim 11, wherein at least the at least one further resonator of the upper and/or lower loops is further defined as a plurality of further resonators coupled together in cascade such that there are a plurality of signal paths between the first and second end resonators.

13. The tuneable bandpass filter as claimed in claim 12, wherein at least some of the plurality of further resonators are coupled together in a cross coupled ladder configuration.

14. The tuneable bandpass filter as claimed in claim 13, wherein at least some of the plurality of further resonators in the cross coupled ladder configuration further comprise at least one diagonal cross coupling to a resonator of the at least some of the plurality of further resonators on an adjacent cross coupled ladder rung.

15. The tuneable bandpass filter as claimed in claim 1, further comprising a non-resonant input circuit node coupled to one of the first and second end resonators of one of the upper and lower loops.

16. The tuneable bandpass filter as claimed in claim 15, further comprising a group delay equalisation network further coupled between the non-resonant input circuit node and the one of the first and second end resonators connected thereto.

17. The tuneable bandpass filter as claimed in claim 15, further comprising an output circuit node coupled to one of the first and second end resonators of the other of the upper and lower loops.

18. The tuneable bandpass filter as claimed in claim 17, further comprising a group delay equalisation network connected between the output circuit node and the one of the first and second end resonators connected thereto.

* * * * *

UNITED STATES PATENT AND TRADEMARK OFFICE

CERTIFICATE OF CORRECTION

PATENT NO. : 7,915,977 B2
APPLICATION NO. : 11/858024
DATED : March 29, 2011
INVENTOR(S) : John David Rhodes, Christopher Ian Mobbs and David Ibbetson It is certified that error appears in the above-identified patent and that said Letters Patent is hereby corrected as shown below:

On the Title Page

Item (75) Inventors:

After David Ibbetson, please delete "Oxenhope (GB)" and insert --West Yorkshire (GB)--.

Signed and Sealed this
Seventeenth Day of May, 2011

David J. Kappos

David J. Kappos
*Director of the United States Patent and Trademark Office*